United States Patent [19]

Popelier et al.

[11] Patent Number: 5,005,597

[45] Date of Patent: Apr. 9, 1991

[54] STREET CLEANING DEVICE FOR COLLECTING LEAVES AND DEBRIS

[75] Inventors: Maurice A. Popelier, East Moline; Myron L. McCunn, Orion, both of Ill.; David C. Winter, Johnston, Iowa; Dennis L. Marchael, Des Moines, Iowa; James W. Hall, Bettendorf, Iowa; Ronald E. Rohren, Moline, Ill.

[73] Assignee: Deere & Company, Moline, Ill.

[21] Appl. No.: 302,091

[22] Filed: Jan. 19, 1989

Related U.S. Application Data

[63] Continuation of Ser. No. 103,227, Sep. 30, 1987, abandoned.

[51] Int. Cl.[5] ..... E01H 1/04

[52] U.S. Cl. ..... 134/25.1; 134/43; 134/45; 15/340.1; 56/289; 56/294

[58] Field of Search ..... 134/25.1, 25.3, 25.4, 134/43, 45; 15/340; 56/505, 294, 320.1, 504

[56] References Cited

U.S. PATENT DOCUMENTS

| | | | |
|---|---|---|---|
| 1,043,533 | 11/1912 | Nolano et al. | 15/340 |
| 2,758,435 | 8/1956 | Landell | 55/118 |
| 3,092,946 | 6/1963 | Mathews | 15/340 |
| 3,113,332 | 12/1963 | Kasper | 15/82 |
| 3,159,957 | 12/1964 | Mathews | 56/24 |
| 3,159,958 | 12/1968 | Mathews | 15/340 |
| 3,189,932 | 6/1965 | Daneman | 15/340 |
| 3,295,299 | 1/1967 | Brady et al. | 56/24 |
| 3,678,671 | 7/1972 | Scainato et al. | 56/505 |
| 3,802,172 | 4/1974 | Mathews | 56/15.8 |
| 3,837,038 | 9/1974 | Kimzey et al. | 15/349 |
| 4,790,128 | 12/1988 | Klinner | 56/364 |

*Primary Examiner*—Anthony McFarlane

[57] ABSTRACT

Leaves and other debris arranged in piles along a roadway are lifted by a flail-type rotary cutting device towed centrally behind a tractor. The device includes a containment hood having a forwardly opening throat which is adjustable to conform generally to the size of the piles for receiving the piles and restricting the material from being thrown forwardly from under the hood particularly at the end of a pile. The lifted material is delivered into a receptacle towed behind the cutting device. The rotary cutting device can handle leaves and other debris in states ranging from dry and fluffy to frozen and snow-covered. The tractor and/or additional brushes may be used for preliminary piles sizing and positioning. Brushes may also be added to the machine for additional cleaning action and to help part wide piles.

24 Claims, 2 Drawing Sheets

STREET CLEANING DEVICE FOR COLLECTING LEAVES AND DEBRIS

This application is a continuation of application Ser. No. 07/103,227, filed Sept. 30, 1987, now abandoned.

BACKGROUND OF THE INVENTION

The present invention relates generally to street cleaning devices and, more specifically, to a device for picking up leaves and other debris from along streets and roads.

In many municipalities, leaf burning has been banned, and leaves must be collected by street crews in the fall. In a typical situation, property owners deposit leaves in large piles of varying sizes adjacent the street curb. Thereafter, the street crews use one of numerous methods to remove the leaves from the street. Present methods (including sweeping, vacuuming, baling, bagging and loading with front end loaders) are slow, expensive and labor and equipment intensive. Rain and snow present problems especially when attempts are made to vacuum wet material. At low temperatures, the vacuum tubes clog with ice because of the low pressure-high velocity air through the system. Baling and bagging require special handling, and, as with most common methods, large crews are necessary to keep up with the autumn disposal of leaves. Many of the presently used methods tend to block large areas of the roadway during the cleanup operation.

BRIEF DESCRIPTION OF THE INVENTION

It is therefore an object of the present invention to provide an improved method and apparatus for picking up leaves and debris from along streets, roadways and the like. It is a further object to provide such a method and apparatus which reduce the time, expense, labor and equipment requirements for handling the leaves and debris.

It is still another object of the present invention to provide an improved method and apparatus for picking up leaves and debris even when rain, ice and snow may be present. It is a further object to provide such a method and apparatus which reduce the time and manpower required to pick up leaves and debris.

It is yet another object of the present invention to provide an improved method and apparatus for picking up leaves and debris from along streets and roadways which have less of a tendency to block large areas of the street or roadway during the cleanup operation than most previously available methods and apparatus.

It is yet another object of the present invention to provide an improved method and apparatus for picking up leaves and debris from along streets and roadways which provide a good cleaning action in various sizes and types of debris piles, including wet and frozen piles. It is yet another object to provide such a method and apparatus which provides both pickup of debris in the streets and pickup of debris which extends partially over the curb into adjoining property.

In accordance with the above objects, a flail-type rotary cutting device towed centrally behind a tractor or other vehicle includes a containment hood having a forwardly opening throat which is adjustable to conform generally to the size of the piles of material to be collected. The cutting device includes a horizontally disposed, transverse rotor including curved free swinging knives which cut away a portion of the material and generate an air flow under the hood. An upwardly and forwardly directed panel above the opening funnels large piles downwardly toward the opening. An adjustable panel structure is mounted on the hood and is movable on-the-go by a pair of hydraulic cylinders operating in unison to adjust the opening size to the size of the pile. The adjustable panel is moved to its fully raised position for large piles and is moved downwardly for smaller piles and for the ends of the piles. The adjustable panel improves air flow and permits the ends of piles to be picked up cleanly. The flails lift and carry the material over the rotor and into a transverse conveyor to a blower which in turn propels the material rearwardly and upwardly to a receptacle, such as a truck, which is towed centrally behind the cutting device.

The rotary cutting device easily handles leaves and other debris in states changing from dry and fluffy to frozen and snow-covered.

A pile splitting device, preferably in the form of an upright brush mounted for rotation adjacent one side of the cutting device, permits the device to cleanly part wide piles of leaves. A horizontally disposed rotating brush mounted at an angle with respect to the transverse direction on the forward end of the towing vehicle is operable to move leaves from the curb area into the street and, in combination with the underside of the towing vehicle, is utilized to size the debris piles to facilitate entry of the piles into the opening of the cutting device.

A minimum amount of roadway space is utilized during cleanup operation and the system is relatively inexpensive and labor-saving when compared with presently available methods. In addition, weather is less of a factor with the present system than with most previously available systems.

These and other objects, features and advantages of the present invention will become apparent to those skilled in the art from the description which follows and from the drawings.

DESCRIPTION OF THE PREFERRED EMBODIMENT

Figure 1:
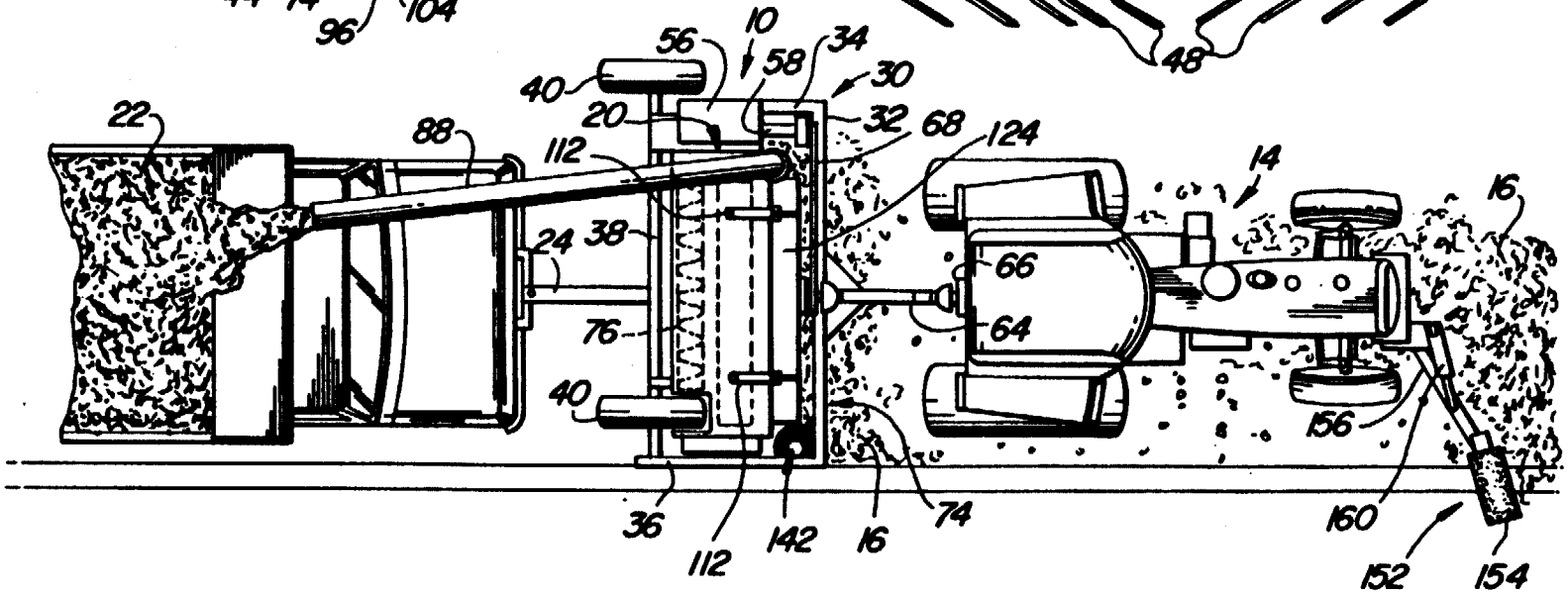
FIG. 1 is a plan view of a preferred embodiment of the present invention.

Referring to FIG. 1, a flail-type cutting implement 10 is shown having forwardly extending hitch structure 12 (FIG. 2) connected to a tractor 14 for towing the implement centrally behind the tractor forwardly over a road or other surface where piles of debris, indicated generally at 16, are located. The cutting implement 10 cuts, lifts and conveys the debris rearwardly and upwardly through a conveying system 20 to a receptacle 22 towed centrally behind the cutting implement 10 by a rearwardly projecting hitch 24.

The cutting device 10 includes a main frame 30 including a forward transversely extending beam 32 connected to the front hitch 12. Side connecting members 34 and 36 extend rearwardly from the beam 32 and support a rear transversely extending tubular beam 38. The frame 30 is supported for forward movement over the ground by a pair of transversely spaced ground engaging wheels 40 secured to the rear tubular beam 38 and adjustable with respect thereto for raising and lowering the working height of the cutting device 10.

Figures 2, 3, 3A:
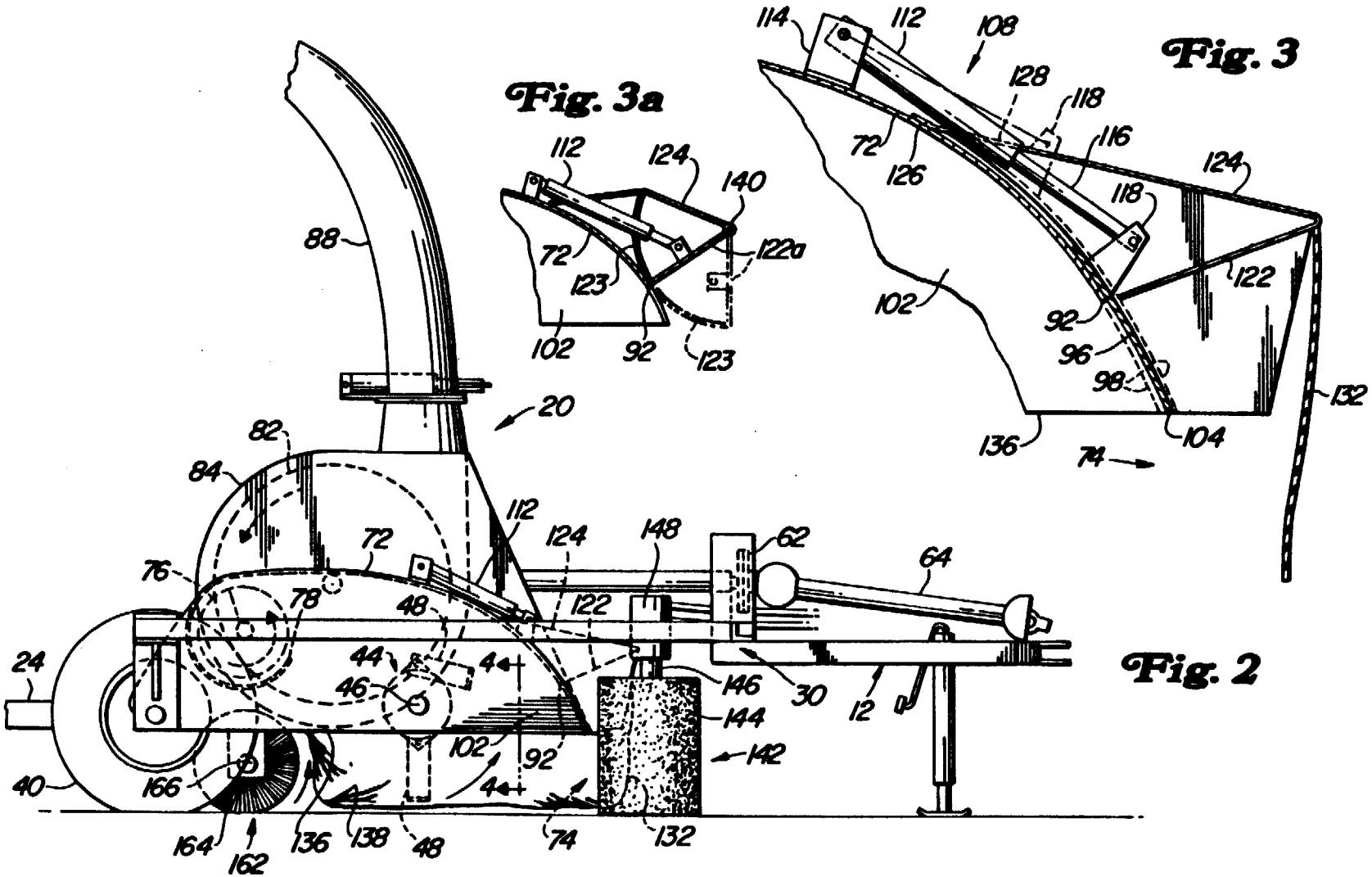
FIG. 2 is an enlarged side view of the flail-type cutting device of the present invention.
FIG. 3 is an enlarged side view of the forward portion of the cutting device of FIG. 2 showing one embodiment of the throat adjusting structure.
FIG. 3*a* is a view similar to FIG. 3 but showing an alternate embodiment of the throat adjusting structure.

A rotor 44 is supported by the frame 30 for rotation about the axis of a transversely extending horizontal shaft 46 between the side connecting members 34 and 36. The rotor 44 includes a plurality of rotor knives or flails 48 pivotally connected to a knife support member 52 mounted for rotation with the shaft 46. The shaft 46 is driven by a conventional transmission 56 including a fore-and-aft extending input shaft 58 mounted for rotation on the frame 30 adjacent the side connecting member 34. A pulley is mounted at the forward end of the input shaft 58 for rotation about the fore-and-aft extending axis and is aligned with a second pulley 62 mounted for rotation about a parallel axis at a central location on the forward part of the frame 30. The pulley 62 is drivingly connected to a shaft 64 which in turn is connected to the tractor PTO 66. The pulley 62 is drivingly connected to the pulley at the forward end of the input shaft 58 by a belt 68. In operation, the rotor 44 is driven in the counterclockwise direction (as shown in FIG. 2), and the rotor knives 48 cut portions of the pile 16 and lift the portions up and over the rotor 44. The lifted material is contained above the rotor 44 by a downwardly concave hood 72 defining an adjustable throat 74 opening in the forward direction for receiving the piles of material therethrough. The hood 72 extends rearwardly to an auger 76 supported for rotation above a transversely extending auger trough 78. Material lifted by the knives 48 over the rotor 44 is directed rearwardly and is conveyed by the auger 76 toward the side of the machine as the auger is driven from the transmission 56.

A fan or cutterhead 82 is supported for rotation about a transverse axis in a housing 84 located at one side of the frame 30. The auger 76 feeds material into the housing 84 and the fan 82 propels the material upwardly through a chute 88 rearwardly to the receptacle 22. In the preferred embodiment, the structure of the rotor 44, auger 76, fan 82 and chute 88 are similar to that of the commercially available John Deere Model 16A Rotary Chopper. The knives 48 are specifically shaped to generate an air flow under the hood 72.

As best seen in FIG. 3, the hood 72 extends forwardly and downwardly to a front edge 92 located forwardly of the rotor 44 and slightly above the level of the rotor shaft 46. Vertically adjustable panel structure 96 is slidably received within flanges 98 extending inwardly from upright side panels 102 fixed to the sides of the hood 72. The panel structure 96 extends substantially the width of the hood 72 and includes a lower forward edge 104 which defines the upper extremity of the throat 74 and which is movable between a lowered position (as shown in FIG. 3) located substantially below the front edge 92 of the hood 72, and an upper position wherein the forward edge 104 is generally aligned with the front edge 92. Remotely operable cylinder means 108 are provided at transversely spaced locations along the hood 72 to raise and lower the panel structure 96 to conform to the size of the pile 16.

Each of the cylinder means 108 includes a hydraulic cylinder 112 having a base end pivotally connected to a bracket 114 extending upwardly from the hood 72. The cylinder 112 extends forwardly from the bracket 114 and includes a rod end 116 pivotally connected to a bracket 118 fixed to and extending upwardly from the top portion of the panel structure 96. The cylinders 112 are connected for operation in unison to hydraulic hose structure (not shown) connected to conventional hydraulic control circuitry located in the cab of the tractor 14. As the cylinders 112 are extended, the panel 92 slides downwardly relative to the hood 72 so that the edge 104 is lowered to decrease the size of the throat 74. By retracting the cylinders 112, the panel structure 96 slides upwardly to raise the edge 104 and increase the size of the throat 74.

To help guide tall piles of material downwardly toward the front edge of the hood 92, a forwardly and upwardly inclined panel 122 is connected between the side panels 102 and is supported adjacent the front edge 92 of the hood 72. An upper panel 124 is connected at the forward edge of the panel 122 and extends rearwardly therefrom to a connection with an upper portion of the hood 72 at location 126. A plurality of resilient flaps 132 depend from the forward edge of the panel 122 for shielding the forward portion of the cutting device while permitting piles of material to enter the throat 74. As seen in FIGS. 2 and 3, the side panels 102 terminate in lower edges 136 which are generally horizontal and located substantially above the surface of the ground. To close the compartment area below the hood 72, additional side flap members 138 (FIG. 2) are connected to the edges 136 and extend rearwardly from the front of the side panels 122 to a location rearwardly of the rotor 44.

In the alternate embodiment of FIG. 3*a*, rather than using the sliding panel 96 as shown in FIG. 3, the forwardly and upwardly inclined panel 122*a* is hinged from the upper panel 124 at 140 and is operably connected to the hydraulic cylinders 112 so that upon extension of the cylinders 112 (dotted lines) the panel 122*a* will swing downwardly to decrease the size of the throat 74. A flange 123 connected to the panel 122*a* closes the compartment between the bottom of the panel and the edge 92. Upon retraction of the cylinder 112 to the position shown in the solid lines of FIG. 3*a*, the panel 122*a* moves adjacent the front edge 92 of the hood 72 to increase the size of the throat 74.

Rotating brush structure 142 is supported from the frame 30 adjacent one side of the throat 74 for moving material toward the throat and, when the cutting device 10 is operated in very wide piles of leaves and debris, for parting the pile. The structure 142 includes an upright brush 144 mounted on an upright shaft 146 and driven by a hydraulic motor 148. As shown in FIG. 1, the rotating upright brush 144 acts to direct debris located on one side of the machine toward the throat 74. When very wide piles of leaves and debris are encountered and two or more passes are required to collect the debris, the brush acts as a pile divider to provide a relatively clean separation area.

A second rotating brush structure 152 is supported from the frame of the tractor 14 for moving leaves and other debris inwardly from the street curb or the like into alignment with the throat 74. The structure 152 includes a brush 154 supported for rotation about a horizontal axis angled from the transverse direction by adjustable support structure 156 connected to the tractor frame. The brush 154 is rotated by a hydraulic motor 158 or other suitable drive structure. The rotating brush structure 152 helps to size the piles and align the piles with the throat 74. The structure 152 also permits the operator to remove debris from the curb area which otherwise might be inaccessible to the cutting device 10. Hydraulic cylinder means 160 are provided on the support structure 156 to adjust the brush 54 to the optimum position.

Trailing brush structure 162 including a brush 164 mounted for rotation with a transversely extending horizontal brush shaft 166 is supported from the frame 30 generally below the auger 76. The shaft 166 is drivingly connected to the transmission 56 for rotation with the rotor 44 to brush residual debris upwardly from the road surface for deposit into the auger 76.

Figure 4:
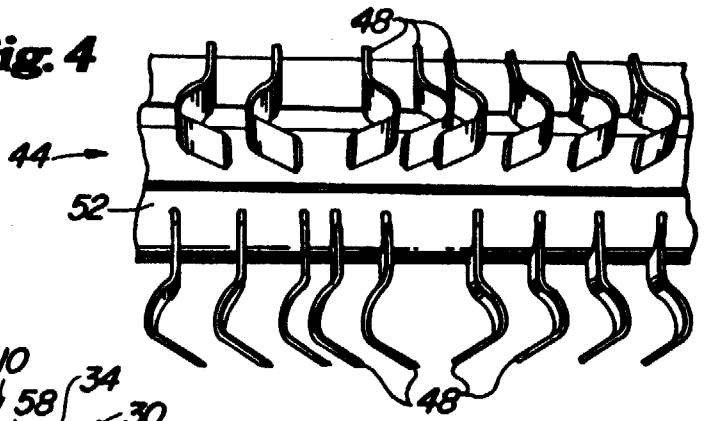
FIG. 4 is a view taken essentially along lines 4—4 of FIG. 2 and showing the general configuration of the rotor knives.
Figure 6:
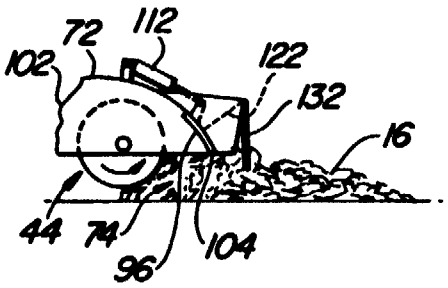
FIG. 6 is a view similar to FIG. 5 but showing the throat adjusted for receiving the end of a pile of leaves.
Figure 5:
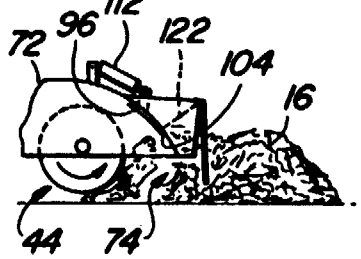
FIG. 5 is a side schematic view of the cutting device of FIGS. 1 and 2 showing the throat adjusted for receiving a large pile of leaves.

In operation, the tractor 14 tows the cutting device 10 over the piles 16 which enter the throat 74 and are lifted by the knives 48 and directed into the auger 76. The auger 76 delivers the lifted material to the cutterhead 82 which propels the material upwardly and rearwardly through the chute 88 to the receptacle 22 which is towed rearwardly behind the cutting device 10. When large piles of leaves are encountered (FIG. 5) the operator retracts the cylinders 112 to maximize the area of the throat 74. The panel 122 helps to funnel the tops of the piles downwardly toward the upper edge 92 of the hood 72. As the piles decrease in height (FIG. 6) the operator extends the cylinder 112 to reduce the height of the throat 174 which helps to maintain the forward portion of the housing closed to reduce the amount of material that is thrown forwardly out the throat 74 and to optimize the air flow under the hood 72 induced by the rotating knives 48. This on-the-go adjustable throat feature permits the ends of piles to be cleanly picked up. The trailing brush structure 162 provides additional cleaning action.

The tractor, as it is driven forwardly over the piles 16, sizes the piles for better entry under the front edge 92 of the hood 72. Each of the rotor knives 48 cuts away a portion of the pile as the cutting device 10 is moved forwardly over the pile. The knives 48 permit even frozen and snow covered piles of debris to be lifted from the roadway.

In the preferred embodiment, the receptacle 22 is a self-propelled type, such as a dump truck, so that once the receptacle is filled it can be easily transported to a dump site. One can see from the above-described structure that a chopping action is provided as the flails 48 cut into the piles of debris. This action reduces material size and lessens the amount of air entrained in the material deposited in the receptacle 22 for a more compact load which results in fewer trips to the dump site. In addition, the system can easily handle sticks and the like which would otherwise cause problems in many conventional systems.

Having described the preferred embodiment, it will be apparent that modifications can be made without departing from the scope of the invention as defined in the accompanying claims.

We claim:

1. A device adapted for movement forwardly over a street by a propelling vehicle having an operator station, the device for collecting material including leaves and debris arranged in piles of varying sizes lying in the street, comprising:

a frame supported for forward movement over the ground;

a cutting device rotatably supported by the frame for rotation about a transversely extending and generally horizontal axis, the cutting device including pivoting flails adapted for movement closely adjacent the surface of the ground;

means for rotating the cutting device to bring the flails in contact with portions of the piles and lift the material over the cutting device;

hood means including a forwardly opening and transversely extending throat for receiving the piles of material as the frame is moved forwardly, said hood means extending over the cutting device for retaining the material as the material is lifted;

moveable structure supported by the frame adjacent the throat;

means varying the size of the throat from a location remote from the hood means as the frame is moved forwardly to conform generally to the size of the pile being received by the throat to thereby restrict material from being thrown forwardly through the throat while facilitating entry of the pile into the throat, wherein said means varying the size of the throat includes motor means operably connected to the moveable structure and controllable from the operator station to change the position of the moveable structure while the frame is moved forwardly; and means for delivering the lifted material to a receptacle.

2. The device as set forth in claim 1 wherein the means for varying the size of the throat includes a panel movably supported adjacent the cutting device, and the motor means connected to the panel for moving the panel relative to the hood means.

3. The device as set forth in claim 2 wherein the motor means for moving the panel includes a hydraulic cylinder connected between the hood means and the panel.

4. The device as set forth in claim 2 further including means for funneling the piles downwardly toward the throat comprising inclined panel structure connected to the hood adjacent the throat and extending upwardly and forwardly from the throat.

5. The device as set forth in claim 2 wherein the panel includes an edge portion pivotally connected to the hood, and the means for moving the panel comprises means for pivoting the panel.

6. The device as set forth in claim 4 wherein the panel projects downwardly from the hood means and is slidable vertically below the inclined panel structure.

7. The device as set forth in claim 1 including a pile-engaging member rotatably supported adjacent one side of the throat, and means for rotating the member in contact with the piles about an upright axis as the frame is moved forwardly to divide the piles and direct a portion of the piles toward the throat.

8. The device as set forth in claim 1 including a transversely extending trailing brush supported for rotation about a horizontal axis rearwardly of the cutting device in contact with the ground.

9. The device as set forth in claim 1 including a forwardly extending hitch connected to a central portion of the frame over the throat and adapted for connection to a towing vehicle, a drive shaft supported for rotation over the hitch wherein the means for rotating the cutting device includes a drive transmission supported on the frame on one side of the throat and having a driven pulley mounted for rotation about a fore-and-aft extending axis, a drive pulley supported for rotation with the drive shaft in alignment with the driven pulley, and endless drive means drivingly connecting the drive and driven pulley.

A device for collecting material including leaves and debris including sticks, ice or snow arranged in piles of varying sizes from the ground, comprising:

a frame supported for forward movement over the ground;

a cutting device rotatably supported by the frame for rotation about a generally transverse horizontal axis;

means for rotating the cutting device in contact with the piles of material to lift the material over the cutting device, said cutting device including chopping means for reducing the size of the material and lessening the amount of air entrained in the material, said chopping means including flail structure for chopping the debris close to the surface of the ground as the cutting device is rotated;

hood means including a forwardly opening and transversely extending adjustable throat for receiving the piles of material as the frame is moved forwardly, said hood means extending over the cutting device for retaining the material as the material is lifted;

means for generally closing the throat over the piles while the frame is moved forwardly to thereby restrict material from being thrown forwardly through the throat while facilitating entry of the pile into the throat, the means for generally closing the throat including a motor connected to the hood means and operable from a location remote from the hood means to adjust the size of the throat; and means for delivering the lifted material to a receptacle.

11. The device as set forth in claim 10 wherein the means for generally closing the throat includes a panel movably supported adjacent the cutting device, and means for moving the panel relative to the hood means to conform the size of the throat to the size of the pile.

12. The device as set forth in claim 10 further including means for funneling the piles downwardly toward the throat comprising inclined panel structure connected to the hood adjacent the throat and extending upwardly and forwardly from the throat.

13. The device as set forth in claim 12 including rotatably pile arranging structure offset from the throat, and means for rotating the pile arranging structure as the frame is moved forwardly to size the piles prior to entry into the throat.

14. A method of collecting material including leaves and debris arranged in piles of varying sizes in a street, comprising:

supporting a cutting device having flails for rotation about a transversely extending horizontal axis under a hood, said hood defining a forwardly opening and transversely extending throat;

moving the cutting device forwardly over the piles of material and directing the piles into the throat;

rotating the cutting device in contact with the piles directed into the throat and lifting the material from the street;

conveying the lifted material into a receptacle; and adjusting the size of the throat to conform generally to the size of the piles directed into the throat as the cutting device is moved forwardly thereby restricting material from being thrown forwardly through the throat while facilitating entry of the pile into the throat.

15. The method as set forth in claim 14 wherein the step of adjusting the size of the throat includes moving a panel relative to the hood.

16. The method as set forth in claim 14 including the step of funneling upper portions of the piles downwardly toward the throat, said step of funneling including supporting an inclined panel forwardly above the throat.

17. The method as set forth in claim 16 further including limiting egress of material forwardly from the throat by supporting flaps from the inclined panel.

18. The method as set forth in claim 14 further including the step of rotating a brush about an upright axis adjacent one side of the throat.

19. The method as set forth in claim 14 including:

towing the cutting device centrally behind a towing vehicle; and sizing the piles with the towing vehicle to conform to the throat.

20. The method as set forth in claim 14 including:

towing the cutting device centrally behind a towing vehicle; and providing a hitch on the cutting device and towing a receptacle centrally behind the cutting device with the hitch.

21. The method as set forth in claim 19 wherein the step of sizing includes driving over the piles with the towing vehicle to thereby limit the height of the piles.

22. The method as set forth in claim 12 including:

rotating a brush about a horizontal axis located outwardly and forwardly of the throat to thereby direct leaves into alignment with the throat.

23. The method as set forth in claim 22 including rotating the brush along a path offset to one side of the street while maintaining the cutting device in the street.

24. The method as set forth in claim 12 wherein the step of adjusting the size of the throat includes moving the inclined panel relative to the hood.

* * * * *